United States Patent [19]

Sauer

[11] 4,007,546

[45] Feb. 15, 1977

[54] CLOTHES DRYER WITH FLEXIBLE DRUM

[75] Inventor: Leo H. Sauer, St. Joseph, Mich.

[73] Assignee: Whirlpool Corporation, Benton Harbor, Mich.

[22] Filed: Aug. 6, 1975

[21] Appl. No.: 602,235

[52] U.S. Cl. ..... 34/133; 34/242; 34/157

[51] Int. Cl.[2] ..... F26B 11/02

[58] Field of Search ..... 34/132–134, 34/138, 139, 242, 108; 277/152, 157, 235, 227, 229; 432/115

[56] References Cited

UNITED STATES PATENTS

| | | | |
|---|---|---|---|
| 3,816,942 | 6/1974 | Smith | 34/133 |
| 3,828,445 | 8/1974 | Smoot | 34/242 |
| 3,875,686 | 4/1975 | Smoot | 34/242 |
| 3,932,947 | 1/1976 | Smoot | 34/242 |

*Primary Examiner*—John J. Camby
*Assistant Examiner*—Larry I. Schwartz
*Attorney, Agent, or Firm*—Hill, Gross, Simpson, Van Santen, Steadman, Chiara & Simpson

[57] ABSTRACT

An endless flexible sheet form member defines a loop having opposite circumferential edge portions and which may be moved relative to front and rear stationary bulkheads which support and guide the loop to form a clothes drying drum of a desired shape to optimize clothes tumbling patterns and the utilization of dryer cabinet space. Means are provided to form a seal between the movable drum and the stationary bulkheads.

18 Claims, 5 Drawing Figures

CLOTHES DRYER WITH FLEXIBLE DRUM

BACKGROUND OF THE INVENTION

1. Field of the Invention

This invention relates to automatic clothes dryer appliances and particularly to the structure of a drum therein in which clothes are tumbled and exposed to temperature-conditioned air.

2. Description of the Prior Art

In conventional clothes drying appliances a drum in the form of a rigid, hollow cylinder which may be open at one or both ends is rotatably mounted within a dryer cabinet and driven by a motor through a large drive belt encompassing the perimeter of the drum and in frictional contact with the cylindrical sidewall of the drum about most of that perimeter. Bearing means such as, for example, wheels or roller bearings fixed to the dryer cabinet are provided to support the drum and facilitate its rotation. In such conventional dryers the shape of the drum is fixed, with its cylindrical diameter limited to that which will fit within the height and width of the cabinet. U.S. Pat. Nos. 3,409,997 (assigned to the assignee of the present invention) and 3,584,393 each show a rigid, cylindrical drum rotatably mounted at each end with respect to front and rear bulkheads of the dryer cabinet, the bulkheads forming front and rear walls for the drum with seals provided to prevent air leakage past the edges of the drum sidewall.

SUMMARY OF THE INVENTION

A dryer drum is defined by an endless flexible wall member in combination with front and rear bulkheads of the cabinet, thus facilitating a drum which is not limited to a cylindrical shape. The flexible wall member, which may be an endless flexible sheet of stainless steel, resembles a large belt which is supported and guided by a pair of corresponding tracks in respective front and rear bulkheads forming a continuous path which may be disposed in an optimum shape not limited to a circular path. The wall member or belt is driven along this continuous path by motor means through a drive belt encircling and frictionally engaging the drum. Transverse baffles may be provided on the inside surface of the wall member to assist in tumbling the contents of the drum. The drum perimeter is defined by the tracks of the respective front and rear bulkheads, thus allowing the shape of the drum to be limited substantially only by the dimensions of the dryer cabinet and the flexibility of the belt material comprising the drum's wall member.

The result is a wide range of design possibilities for achieving optimum tumbling patterns and air movement to provide efficient drying and a desirable finish to the items being dried, large drum capacity in relationship to cabinet size, and easy access to the interior of the drum through a large and relatively high access opening.

Virtually any desired configuration of annular tracks may be employed to support and guide the edges of the drum wall. An illustrated embodiment which has demonstrated improved performance over prior art structures comprises a pair of corresponding, oppositely-facing, elliptically disposed, endless channels or grooves, one in each bulkhead. Each edge portion of the wall or belt member in this embodiment has a strip of felt-like material bonded thereto to ride in the groove, or alternatively, the material may be fixed in the groove with the belt travelling with respect thereto. This material, which may be Teflon pile, provides both sealing and bearing functions.

DESCRIPTION OF THE PREFERRED EMBODIMENTS

Figure 1:
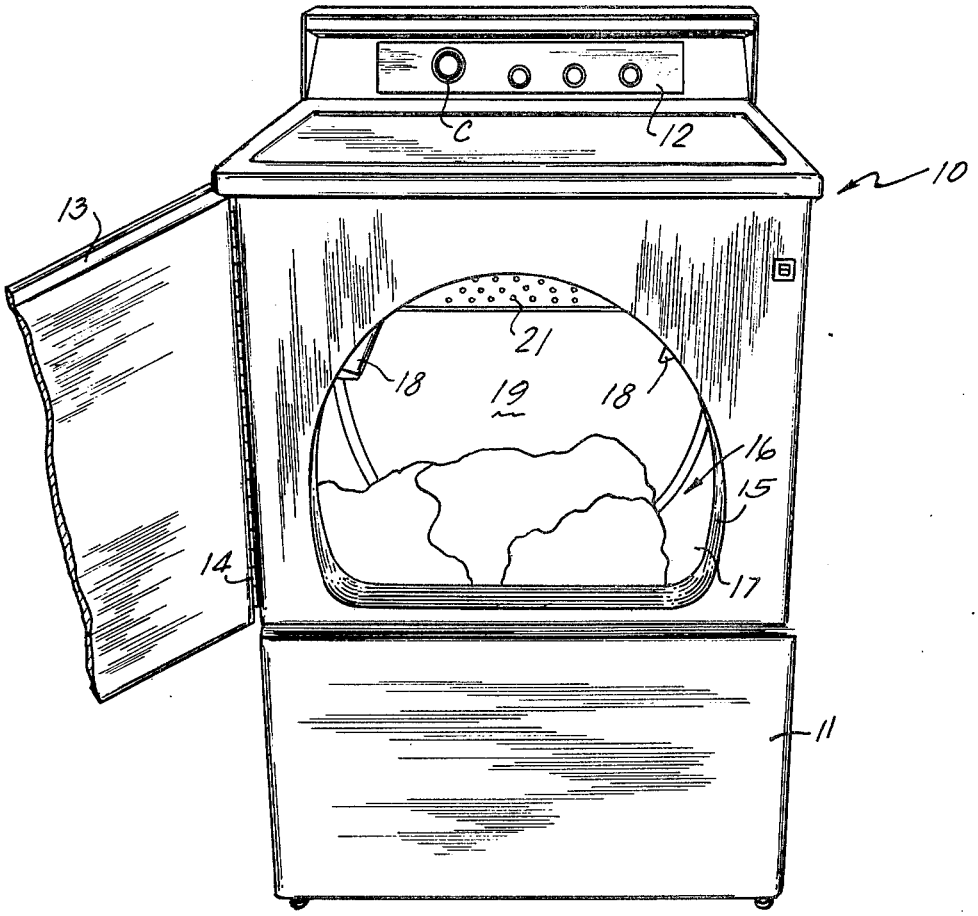
FIG. 1 is a perspective view of an automatic clothes dryer embodying the principles of the present invention and with the access door open and partially broken away.

An automatic clothes dryer is shown generally at 10 in FIG. 1, having a cabinet 11 and a control panel 12 provided with suitable controls C by which the machine may be preset by an operator to execute a programmed drying cycle. A door 13, hinged to the cabinet 11 at 14, exposes an opening 15 providing access to the interior of a drum 16.

For the peripheral wall of the drum there is provided a sheet form flexible wall member 17 formed as an endless belt or loop. For example, the wall member 17 can be advantageously formed from a band of flexible stainless steel. The flexible member could also be made of plastic, for example a fire retardant polypropylene. Any suitable material can be utilized as long as the flexible member 17 is of sufficient rigidity to display the necessary lateral stability while exhibiting sufficient circumferential or annular flexibility to move through successively changing degrees of curvature, as will occur, for example, where the drum 16 is non-circular. Of course, the material used must be able to withstand the temperatures present in the drum of a clothes dryer and must be able to withstand the stresses generated in the repeated continuous flexing over the life of the dryer.

Figure 2:
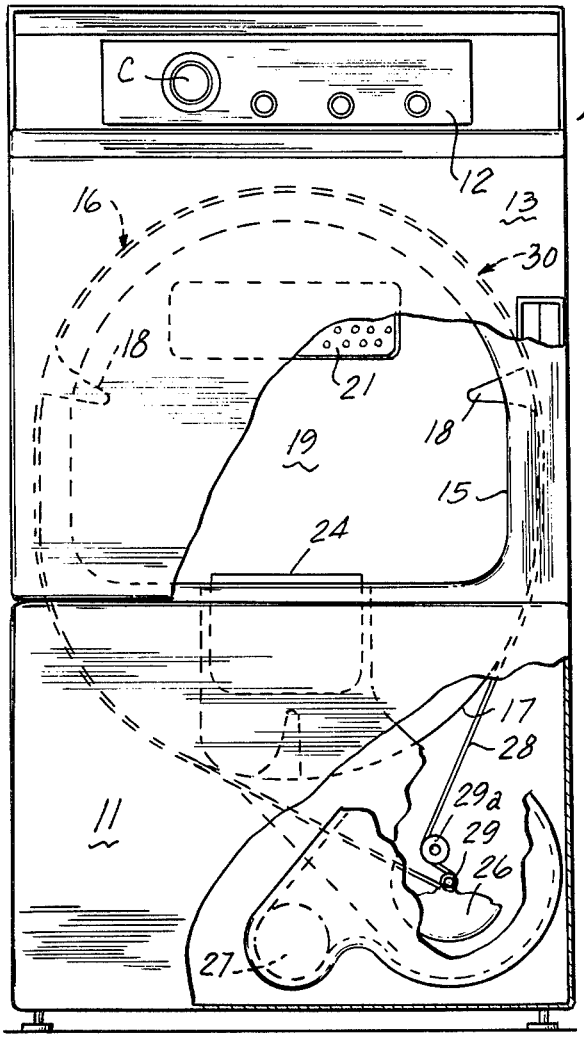
FIG. 2 is a front elevational view, with parts broken away and some of the internal components of the machine shown in phantom.

In a presently preferred form of the invention an elliptical drum shape has been utilized wherein the drum is taller than it is wide. This drum shape provides three basic advantages over the cylindrical shape of a conventional dryer drum. First, the elliptical drum can more efficiently utilize the volume of a cabinet having a rectangular cross section. The volume of a cylindrical drum is limited by a drum diameter which cannot be greater than the height or width (whichever is smaller) of the cabinet interior, but an elliptical drum can be tailored to take full advantage of both the height and width dimensions of the cabinet interior. Second, an elliptical drum can provide for a larger higher access opening to the drum as can be seen in FIG. 2. And third, an elliptical drum can provide more efficient drying and an improved finish to the items being dried because of the relatively long drop (from the top to the bottom of the drum) to which the items may be subjected (as indicated in FIG. 2) provided the drum is not overloaded. Thus as the drum rotates baffles 18, which may be attached to wall member 17, carry items being dried from the bottom to the upper portion of the drum and allow them to fall once again to the bottom. As the items fall they tend to loosen up (as opposed to being balled together) and are more thoroughly exposed to the heated air flowing through the dryer drum. This facilitates efficient drying of the items and, in the case of permanent press items, particularly large permanent press items such as sheets, minimizes the extent to which wrinkles will be present in the items when finally dry as compared to drying in a conventional dryer.

As already indicated, interior of the drum 16 may be provided with one or more baffles 18 connected to or formed on the inside surface of the loop 17 and extending in the transverse direction with respect to the drum 16. Such baffles not only assist in tumbling articles within the interior of the drum but also may help to rigidify the member 17 transversely without interfering with the requisite circumferential or annular flexibility.

Figure 3:
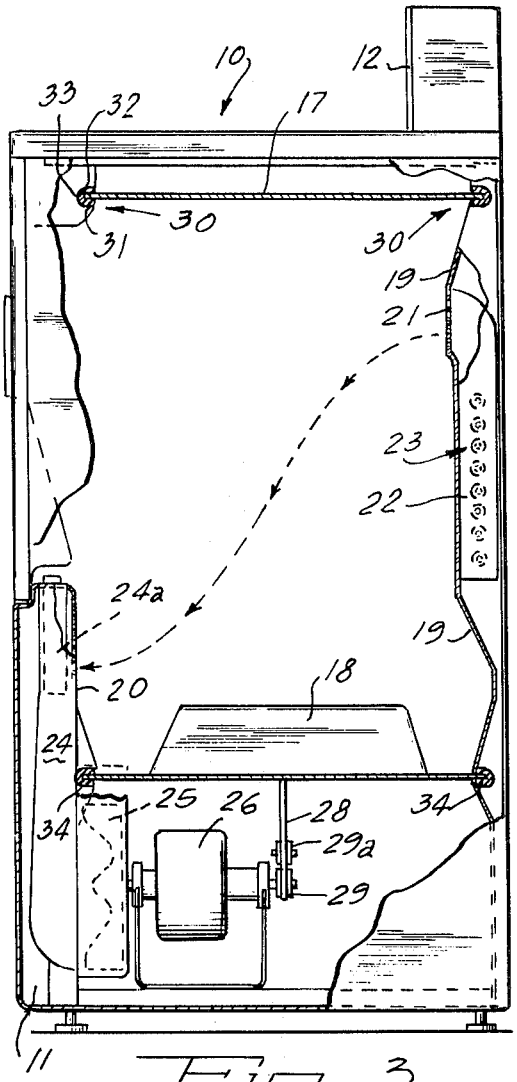
FIG. 3 is a side elevational view of the structure of FIG. 2, with parts broken away to show additional details of the machine.

In the embodiment of the invention shown in FIGS. 2 and 3 the member 17 extends substantially between a fixed rear drum end wall 19 and a front drum end wall 20, as best seen in FIG. 3. The rear wall or bulkhead 19 is fitted with an air inlet screen 21 leading from a duct 22 having appropriate heating means such as gas burners or electrical heating elements, as the case may be, but in any event shown generally at 23. An air exhaust duct 24 and lint screen **24*a* are provided near the front wall or bulkhead 20 of the machine. The duct 24 communicates with a suction fan or blower 25 driven by a dryer motor 26 and feeds to an exhaust port 27 indicated in FIG. 2**.

Figure 4:
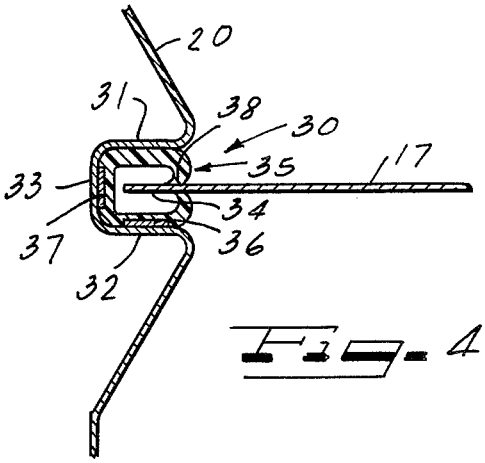
FIG. 4 is a fragmentary enlarged cross-sectional view showing an upper portion of the track, and the drum side wall edge seal and bearing for guiding and supporting the flexible drum sidewall member of the present invention.

In order to confine the edge portions of the member 17 in accordance with the principles of the present invention, the rear wall 19 and front wall 20 may be formed with corresponding, but opposite-facing, tracks such as endless grooves or channels 30, 30. In the illustrated embodiment the channels 30 are disposed in a generally elliptical configuration or path on the bulkheads as seen in FIG. 2. Referring to FIG. 3 and FIG. 4, each track comprises a U-shaped groove having a radially inwardly facing wall 31, a radially outwardly facing wall 32, and an axially-facing wall 33.

Each groove or channel 30 receives an edge portion of the flexible member or sidewall 17 of the drum 16, as shown in FIG. 3. Thus, the shape of the drum may be oblong or elliptical or egg shaped as may be desired, thereby facilitating more efficient use of the space available within a cabinet. As mentioned the greater height of the elliptical drum of the illustrated preferred embodiment wherein the major axis of the ellipse extends in the vertical direction provides certain advantages including a higher drop for increased drying efficiency since the articles are exposed for longer periods to the flow of hot air through the drum, depicted by the arrows in FIG. 3.

Each edge portion 34 of member 17 is positioned with respect to the walls 31–33 of the track 30 by any suitable type of sealing and bearing member 35, which in one form may be a felt-like material such as a Teflon pile affixed either to the track 30 or to the edge portion 34 of the sidewall 17. Attachment to the sidewall 17 appears to increase the life of the seal by distributing wear evenly over the entire length of the seal. The sealing and bearing member 35 as shown in FIG. 4 will provide bearing support to the wall 17 against gravitational and drive force displacements through bearing portion 36, and will keep the member 17 substantially centered between the walls 19 and 20 through a thrust bearing portion 37. Sealing portion 38 of member 35 also provides a seal along edge portions 34 of the belt member 17 against leakage of air from the drum 16 as shown in FIG. 4. The bearing surface provided by portion 36 will also contribute to the seal about the perimeter of the sidewall 17, and the portion 38 will tend to act as a bearing near the top of the groove or channel 30.

The sidewall 17 of the drum 16 is rotated by means of a drive belt 28 driven by a pulley 29 attached to the drive shaft of the dryer motor 26. A tensioner or idler pulley **29*a* may be provided to maintain a proper tension on the belt 28 around the sidewall 17, so that the belt 28 will frictionally engage the outer surface of the sidewall 17 and rotate it in the track formed by the channel 30**.

Figure 5:
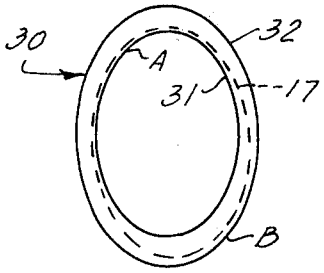
FIG. 5 is a schematic diagram indicating the path the flexible drum member may follow along its supporting track and bearings.

As indicated in FIG. 5 (somewhat exaggerated to show the path of the flexible side wall), the flexible sidewall 17 of the drum 16 may not ride in the true center of the track 30 but rather will tend to be somewhat displaced therefrom by a combination of gravitational forces and the drive forces from the drive belt 28 despite the guidance and support of the sealing and bearing member. The sidewall edge portions 34 will ride principally on the inwardly facing wall 31 at or near the upper left portion of the track 30 as at A, and will ride principally on the outwardly facing wall 32 at or near the lower right hand side of the track 30, as at B.

In operation, the drive motor 26 will rotate the drive pulley 29 which drives the belt 28 and, through frictional engagement along its surface, the flexible sidewall 17 of the drum 16. The drum wall 17 will rotate in the annular direction along the tracks formed by the grooves or channels 30, 30 which engage the sidewall edge portions 34, 34. The sidewall 17 will carry its internal baffles 18 about the drum 16, tumbling items or articles of clothing within the drum 16 and exposing these items to the stream of air passing through the drum 16 from the air inlet duct 21 through the air exhaust duct 24. Because the drum 16 is defined in the illustrated embodiment with an elliptical shape by the tracks to which the flexible sidewall 17 conforms with the major axis of the ellipse extending vertically, clothes carried upwardly on the baffles 18 will have a greater distance to fall through the generally moving stream of temperature-conditioned air than in a comparable cylindrical drying drum, resulting in improved, faster and more uniform drying of clothes.

Although, as indicated herein, an elliptical drum constitutes a preferred form of the invention disclosed in this application, the invention is not limited to any particular shape or form. Other drum shapes and configurations may be advantageous in any particular case depending upon such variables as cabinet size and shape, other dryer components sharing interior cabinet space with the drum, the type of drying to be done, and the manner in which conditioned air is to be supplied to the drum, to name just a few. All such variations in drum shape and configuration are readily achievable through the present invention. Similarly, the present invention is not limited to any particular form of front or rear bulkhead, to any particular form of track means for supporting or guiding the flexible wall member of the drum, or to any particular form of sealing means for sealing the drum adjacent the edge portions of the flexible drum sidewall. Many such variations and modifications may be suggested by those versed in the art, and it should be understood that I wish to embody within the scope of the patent warranted hereon all such modifications as reasonably and properly come within the scope of my contribution to the art.

The embodiments of the invention in which an exclusive property or privilege is claimed are defined as follows:

1. A clothes drying appliance having a cabinet including front and rear wall portions, a drum mounted within the cabinet for tumbling clothes, drive means for rotatably driving the drum, and means for circulating heated air through the interior of the drum to facilitate drying of the clothes therein; said drum comprising:

a front and a rear bulkhead formed respectively adjacent said front and rear cabinet wall portions, each said bulkhead having surfaces defining corresponding annular tracks thereon; and an endless flexible belt member forming a sidewall of the drum, said belt member including front and rear edge portions mounted for movement adjacent the respective front and rear bulkheads with each edge portion riding one of said tracks, whereby the shape of the drum is defined by said tracks.

2. A clothes drying appliance as defined in claim 1 wherein said tracks comprise a pair of oppositely-facing endless grooves, one defined in each of said respective front and rear bulkheads, and wherein sealing and bearing means are provided between said front and rear edge portions of said belt member and said grooves for cooperating with said grooves to seal and to facilitate said movement of said edge portions with respect to said bulkheads in the rotation of said drum.

3. A clothes drying appliance as defined in claim 1 wherein the tracks comprise a pair of opposite-facing endless grooves, one defined in each of said respective front and rear bulkheads, and wherein sealing and bearing means are provided on said front and rear edge portions respectively of said belt member to seal and to facilitate said movement of said edge portions with respect to said bulkheads in the rotation of said drum.

4. A clothes drying appliance as defined in claim 1, wherein said sidewall of said drum has an elliptical shape.

5. A clothes drying appliance having a flexible drum for tumbling clothes in a stream of heated air, the drum comprising:

an endless belt member formed in an annular loop with an inner surface and an outer surface and a pair of opposite edge portions, each edge portion engaging a different corresponding annular non-circular track defining an annular space radially inwardly of and axially between said edge portions; and a front drum wall and a rear drum wall each carrying one of said tracks and supporting the belt member thereby, thereby to afford a non-cylindrical shape for the drum to effect improved tumbling characteristics for the clothes therein.

6. A clothes drying appliance as defined in claim 5, wherein sealing and bearing means are provided between the tracks and the corresponding edge portions of the belt member carried thereby.

7. A clothes drying appliance having a cabinet containing an annularly rotatable drum for tumbling clothes therein, the drum comprising:

front and rear drum walls fixed in the cabinet, each drum wall having surfaces defining corresponding but oppositely-facing endless annular grooves therein, each said groove lined on three sides with sealing material and bearing material; and an endless belt member extending between the two grooves with a different edge portion thereof occupying each of the grooves, the belt member supported against gravitational and driving forces by the bearing material in said grooves and sealed between its inner and outer surfaces by said seal material in said grooves and flexing during rotation of the drum.

8. A flexible drum for a clothes drying appliance, the appliance having a cabinet including front and rear walls, and the drum comprising:

an endless belt member flexible in its annular direction but stiffened in its transverse direction by inner baffles extending substantially from edge portion to edge portion of the belt member; and said front and rear cabinet walls engaging respective edge portions of the belt member by a pair of annular tracks formed in said walls, the tracks supporting said belt member against gravitational and driving forces while affording low-friction annular movement thereof.

9. A flexible drum as defined in claim 8, wherein each said track also seals one edge portion of the drum to its corresponding cabinet wall to retard escape of substantial quantities of air from said drum.

10. A flexible drum as defined in claim 8, said tracks carrying sealing and bearing materials comprising Teflon pile which engages the inner, outer, and axial edge portion surfaces of the flexible belt material.

11. A flexible rotatable drum for tumbling clothes in a dryer, the drum comprising:

a pair of fixed end members having annular tracks therein carrying sealing and bearing materials; and a flexible sidewall having two edge portions and formed in an endless loop between the end members, each edge portion of the sidewall riding one of the tracks to define a fixed shape for the drum as it rotates annularly.

12. In a dryer, a flexible endless belt member forming the peripheral wall of a drum, front and rear wall means having stationary tracks shaped to receive the opposite edge portions of said drum, said tracks disposed in a configuration selected to prescribe the desired shape of a drum, and drive means to drive said endless member along said tracks.

13. A clothes dryer comprising, in combination:

a flexible band of material formed in an endless loop, means driving said loop circumferentially, first and second end walls spaced apart from one another on opposite sides of said flexible band, and track means engaging and supporting the edges of said flexible band, said track means being disposed in an elongated elliptical shape to form an elongated elliptical drum.

14. A clothes dryer as defined in claim 13, further defined by one of said end walls having a door affording access to the interior of the drum.

15. A clothes dryer as defined in claim 13, further comprising a plurality of baffles connected to said flexible band to assist in tumbling articles within said drum.

16. A clothes dryer as claimed in claim 13, wherein the elongated elliptical shape in which the track means is disposed has its major axis extending in a vertical direction.

17. An elliptical drum for a dryer, said drum comprising:

an endless sidewall member flexible in the circumferential direction and including a pair of opposite edge portions, and front and rear wall members each including means for supporting and guiding said endless sidewall member adjacent a different edge portion thereof for movement along an elliptical path.

18. A dryer comprising:

an endless flexible sidewall member including a pair of opposite edge portions, means for driving said sidewall member circumferentially, a pair of end walls spaced apart from each other on opposite sides of said sidewall member, and track means for supporting said sidewall member with each edge portion adjacent a different end wall and prescribing the path of said circumferential movement of said sidewall member, said sidewall member flexing in the circumferential direction as it moves along said path.

* * * * *